US011783720B2

(12) United States Patent
Teague et al.

(10) Patent No.: US 11,783,720 B2
(45) Date of Patent: Oct. 10, 2023

(54) HIGH TRAFFIC ZONE DISPLAY

(71) Applicant: Rockwell Collins, Inc., Cedar Rapids, IA (US)

(72) Inventors: Jacob G. Teague, West Melbourne, FL (US); Christopher Crain, Palm Bay, FL (US)

(73) Assignee: Rockwell Collins, Inc., Cedar Rapids, IA (US)

( * ) Notice: Subject to any disclaimer, the term of this patent is extended or adjusted under 35 U.S.C. 154(b) by 358 days.

(21) Appl. No.: 17/316,504

(22) Filed: May 10, 2021

(65) Prior Publication Data

US 2022/0358848 A1 Nov. 10, 2022

(51) Int. Cl.
*G08G 5/04* (2006.01)
*G08G 5/00* (2006.01)

(52) U.S. Cl.
CPC ..... *G08G 5/045* (2013.01); *G08G 5/003* (2013.01); *G08G 5/0008* (2013.01); *G08G 5/0021* (2013.01)

(58) Field of Classification Search
CPC .... G08G 5/045; G08G 5/0008; G08G 5/0021; G08G 5/003; G08G 5/0078
See application file for complete search history.

(56) References Cited

U.S. PATENT DOCUMENTS 6,271,768 B1 8/2001 Frazier, Jr. et al.
6,927,703 B2 8/2005 Watson
8,112,224 B2 * 2/2012 Lucas ..... G08G 5/0052 701/16
8,271,186 B2 9/2012 Nouvel et al.
8,285,427 B2 10/2012 Rogers et al.
8,600,587 B1 12/2013 Seah et al.
9,076,326 B2 7/2015 Maji et al.
9,147,349 B2 9/2015 Maddanimath et al.
9,355,565 B2 5/2016 Pepitone et al.
9,508,262 B2 11/2016 Kar et al.
10,562,643 B1 * 2/2020 Strabala ..... G05D 1/101
10,748,435 B2 8/2020 Gadgil et al.
2002/0152029 A1 * 10/2002 Sainthuile ..... G08G 5/045 701/4
2007/0252749 A1 11/2007 Blaskovich et al.
(Continued)

FOREIGN PATENT DOCUMENTS

KR 100221712 B1 9/1999

OTHER PUBLICATIONS

Extended Search Report in European Application No. 22172321.6 dated Oct. 10, 2022, 9 pages.

*Primary Examiner* — Behrang Badii
(74) *Attorney, Agent, or Firm* — Suiter Swantz pc llo

(57) ABSTRACT

A system for rendering local aircraft traffic by defining boundaries of risk receives current aircraft locations for a plurality of aircraft, including altitudes, and determines multiple boundaries of risk for each aircraft. The multiple boundaries of risk are then consolidated according to risk level where such boundaries of multiple aircraft overlap or nearly overlap. Areas of risk are outlined according to common risk levels of multiple aircraft and the original diamond icons are unrendered. Ranges to the nearest aircraft in each direction are identified, and indicators of such direction and range to the nearest aircraft are rendered around the aircraft.

14 Claims, 6 Drawing Sheets

(56) References Cited

U.S. PATENT DOCUMENTS

| | | | | |
|---|---|---|---|---|
| 2008/0103646 | A1* | 5/2008 | Lucas | G05D 1/106<br>244/76 R |
| 2008/0174454 | A1* | 7/2008 | Bitar | G01C 23/00<br>340/975 |

* cited by examiner

HIGH TRAFFIC ZONE DISPLAY

BACKGROUND

Existing aircraft traffic display systems use separate diamond icons to indicate individual traffic targets. As traffic density increases, these icons clutter traffic displays. Traffic density will continue to increase, especially with increasing urban air mobility (UAM) in high populated areas, which will further clutter traffic displays. UAM will also accelerate the need for single pilot capable systems to keep up with demand. Current air traffic systems use range rings to indicate the general distance to objects. In high-traffic areas, such range rings may be difficult see and poorly suited to satisfy the pilot's need for range information.

SUMMARY

In one aspect, embodiments of the inventive concepts disclosed herein are directed to a system for rendering local aircraft traffic by defining boundaries of risk. The system receives current aircraft locations for a plurality of aircraft, including altitudes, and determines multiple boundaries of risk for each aircraft. The multiple boundaries of risk are then consolidated according to risk level where such boundaries of multiple aircraft overlap or nearly overlap. Areas of risk are outlined according to common risk levels of multiple aircraft and the original diamond icons are unrendered.

In a further aspect, ranges to the nearest aircraft in each direction are identified, and indicators of such direction and range to the nearest aircraft are rendered around the aircraft.

It is to be understood that both the foregoing general description and the following detailed description are exemplary and explanatory only and should not restrict the scope of the claims. The accompanying drawings, which are incorporated in and constitute a part of the specification, illustrate exemplary embodiments of the inventive concepts disclosed herein and together with the general description, serve to explain the principles.

BRIEF DESCRIPTION OF THE DRAWINGS

The numerous advantages of the embodiments of the inventive concepts disclosed herein may be better understood by those skilled in the art by reference to the accompanying figures in which.

DETAILED DESCRIPTION

Figure 1:
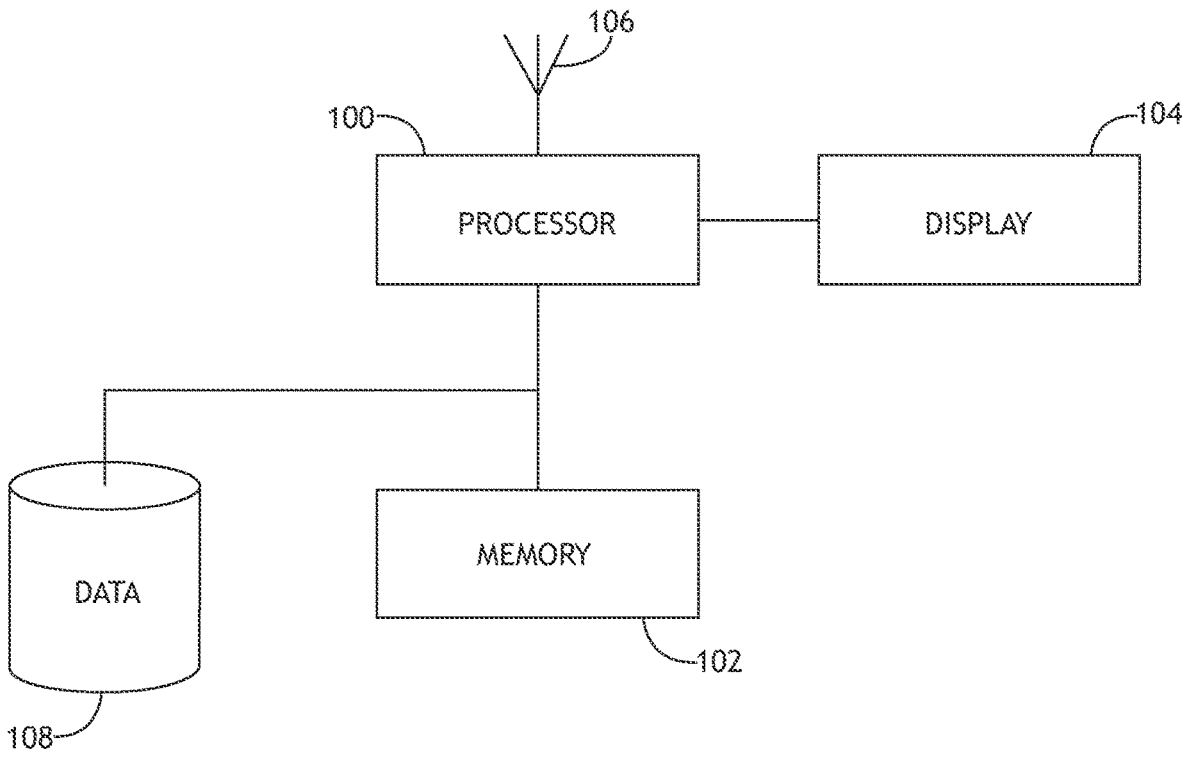
FIG. 1 shows a block diagram of a system suitable for implementing exemplary embodiments.

Before explaining at least one embodiment of the inventive concepts disclosed herein in detail, it is to be understood that the inventive concepts are not limited in their application to the details of construction and the arrangement of the components or steps or methodologies set forth in the following description or illustrated in the drawings. In the following detailed description of embodiments of the instant inventive concepts, numerous specific details are set forth in order to provide a more thorough understanding of the inventive concepts. However, it will be apparent to one of ordinary skill in the art having the benefit of the instant disclosure that the inventive concepts disclosed herein may be practiced without these specific details. In other instances, well-known features may not be described in detail to avoid unnecessarily complicating the instant disclosure. The inventive concepts disclosed herein are capable of other embodiments or of being practiced or carried out in various ways. Also, it is to be understood that the phraseology and terminology employed herein is for the purpose of description and should not be regarded as limiting.

As used herein a letter following a reference numeral is intended to reference an embodiment of the feature or element that may be similar, but not necessarily identical, to a previously described element or feature bearing the same reference numeral (e.g., 1, 1*a*, 1*b*). Such shorthand notations are used for purposes of convenience only, and should not be construed to limit the inventive concepts disclosed herein in any way unless expressly stated to the contrary.

Further, unless expressly stated to the contrary, "or" refers to an inclusive or and not to an exclusive or. For example, a condition A or B is satisfied by anyone of the following: A is true (or present) and B is false (or not present), A is false (or not present) and B is true (or present), and both A and B are true (or present).

In addition, use of the "a" or "an" are employed to describe elements and components of embodiments of the instant inventive concepts. This is done merely for convenience and to give a general sense of the inventive concepts, and "a" and "an" are intended to include one or at least one and the singular also includes the plural unless it is obvious that it is meant otherwise.

Finally, as used herein any reference to "one embodiment," or "some embodiments" means that a particular element, feature, structure, or characteristic described in connection with the embodiment is included in at least one embodiment of the inventive concepts disclosed herein. The appearances of the phrase "in some embodiments" in various places in the specification are not necessarily all referring to the same embodiment, and embodiments of the inventive concepts disclosed may include one or more of the features expressly described or inherently present herein, or any combination of sub-combination of two or more such features, along with any other features which may not necessarily be expressly described or inherently present in the instant disclosure.

Broadly, embodiments of the inventive concepts disclosed herein are directed to a system for rendering local aircraft traffic by defining boundaries of risk. The system receives current aircraft locations for a plurality of aircraft, including altitudes, and determines multiple boundaries of risk for each aircraft. The multiple boundaries of risk are then consolidated according to risk level where such boundaries of multiple aircraft overlap or nearly overlap. Areas of risk are outlined according to common risk levels of multiple aircraft and the original diamond icons are unrendered. Ranges to the nearest aircraft in each direction are identified, and indicators of such direction and range to the nearest aircraft are rendered around the aircraft.

Referring to FIG. 1, a block diagram of a system suitable for implementing exemplary embodiments is shown. The system includes a processor 100, a memory 102 connected to the processor 100 for embodying processor executable code, and a display 104 configured to display traffic related data relative to a present aircraft. The processor 100 receives traffic data either via a datalink 106 or directly via a radar connected to the processor 100, each element of traffic data associated with an aircraft. The processor 100 then identifies a location associated with each aircraft. The processor 100 may determine a trajectory of each aircraft either directly via data received from the aircraft, or indirectly via location data stored over time in a data storage element 108.

Based on the location of each aircraft, the processor 100 determines a plurality of risk boundaries associated with each aircraft based on the proximity of the aircraft to the present aircraft. Each risk boundary corresponds to a threshold risk value defining a likelihood of collision. Furthermore, the risk boundaries may be weighted according to the relative trajectory of each aircraft and differences in altitude. In at least one embodiment, the risk boundaries may also be based on potential course deviations of each aircraft; for example, a high-risk boundary may be defined by a predefined distance from each aircraft, weighted toward the current trajectory of the aircraft. Likewise, a medium-risk boundary may be centered on each aircraft, weighted toward the trajectory of the aircraft, and defined by potential course deviations of the aircraft over a predefined period of time. A low-risk boundary may define possible, but unlikely future locations of each aircraft within a predefined time period.

Where multiple aircraft are proximal to the present aircraft, the risk boundaries may overlap or nearly overlap. The processor 100 determines where similar risk boundaries are proximal or overlap, and merges those risk boundaries into a single unified risk boundary encompassing a plurality of proximal aircraft (for example, defining a single low-risk region encompassing all low-risk boundaries of all proximal aircraft). Individual aircraft icons are then de-rendered or substantially suppressed.

Merging risk boundaries and rendering unified risk regions reduces visual clutter and presents the pilot with the most relevant information (what areas to avoid for traffic reasons).

In at least one embodiment, the processor 100 determines a range to each aircraft relative to the present aircraft, and renders an artifice proximal to a rendered representation of the present aircraft indicating each range. Such artifice is rendered at a relative location to the present aircraft indicating the relative direction of the aircraft with respect to the present aircraft.

In at least one embodiment, where two artifices overlap (two aircraft are located in the same relative direction but at different distances), the artifices are combined to show only the closest range (distance to the nearest aircraft). Such combination reduces clutter and provides only the most necessary information to the pilot.

In at least one embodiment, the artifices crescent shaped indicators centered on the relative direction. The crescent shaped indicators may be weighted toward the current trajectory of the corresponding aircraft.

Figure 2A:
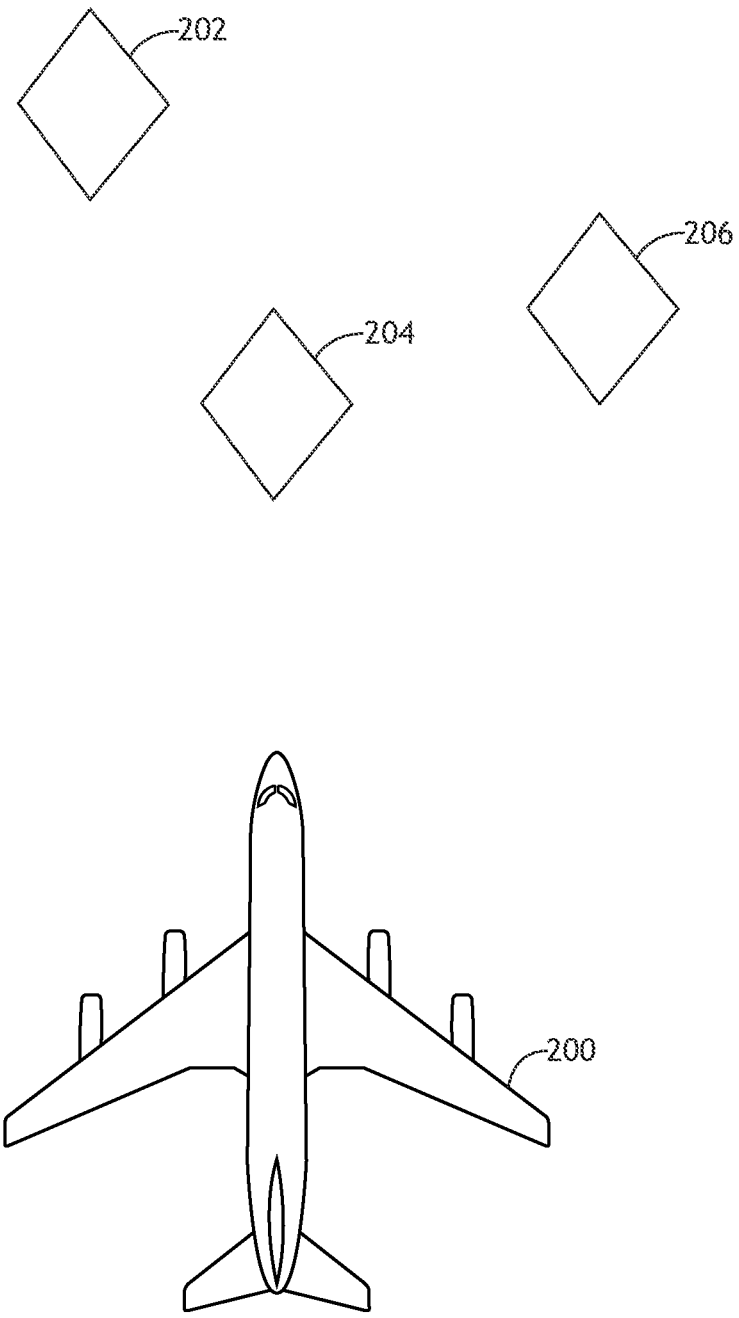
FIG. 2A shows a rendering of a traffic detection display.
Figure 2B:
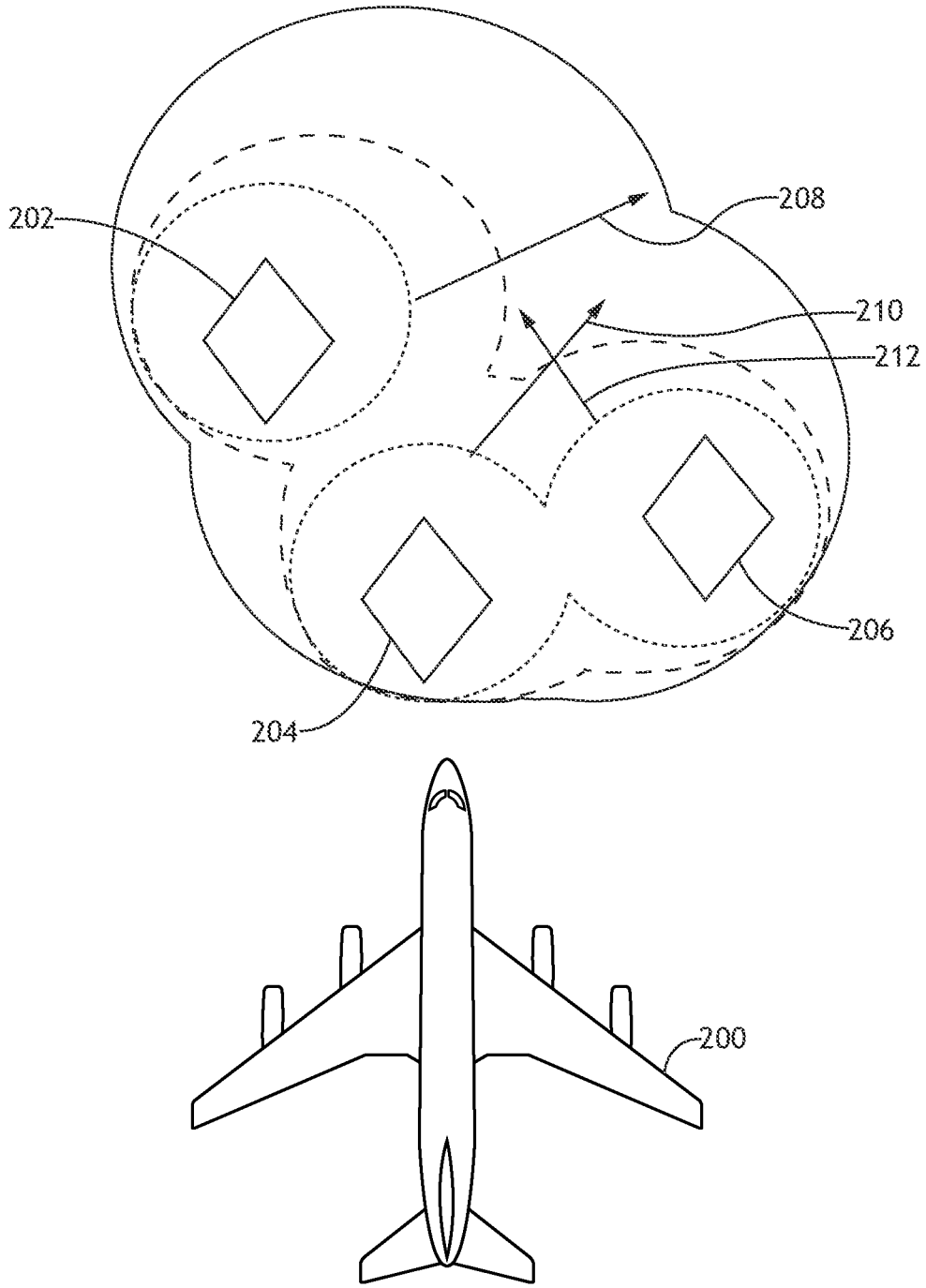
FIG. 2B shows a rendering of a traffic detection display according to an exemplary embodiment.
Figure 2C:
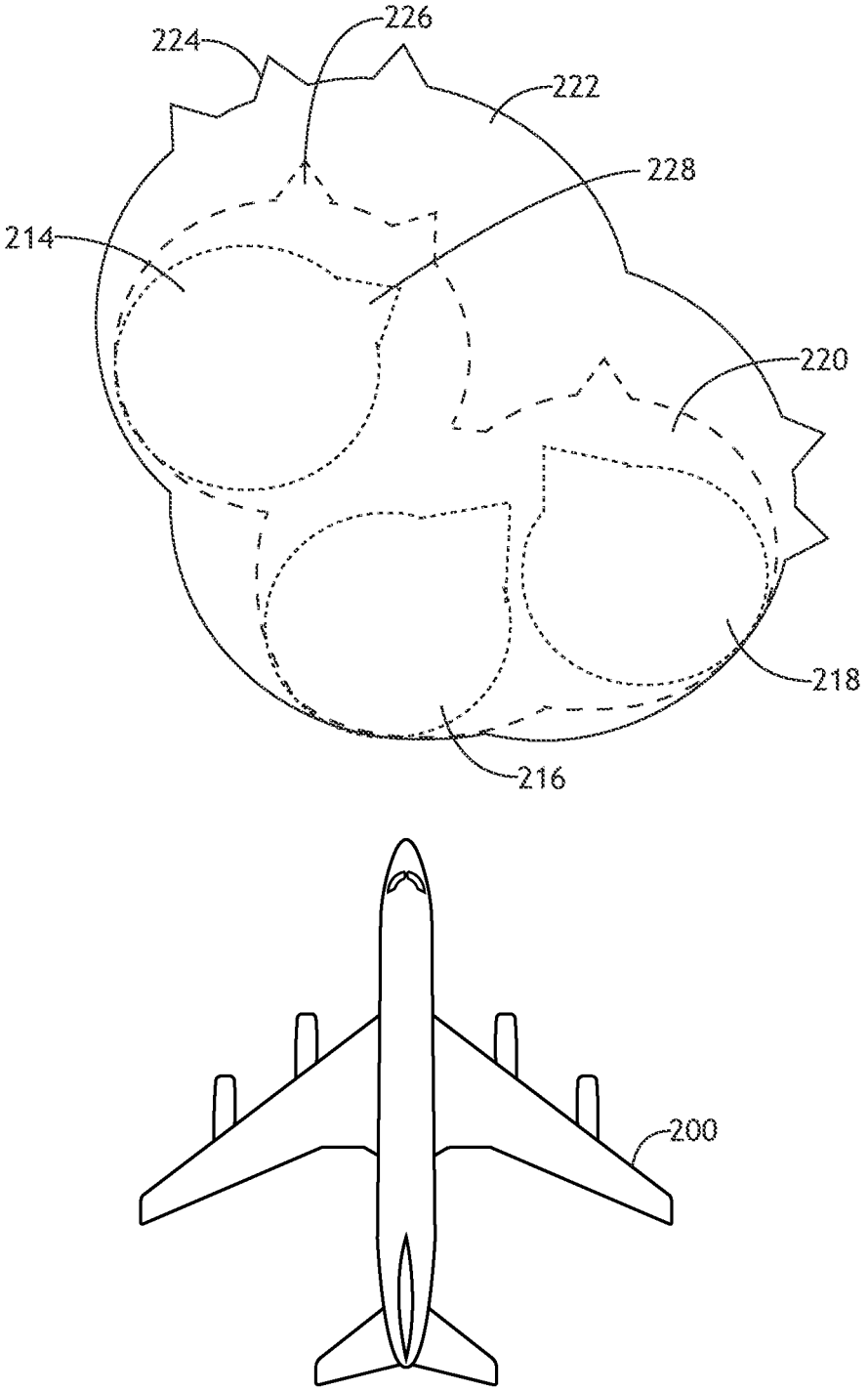
FIG. 2C shows a rendering of a traffic detection display according to an exemplary embodiment.

Referring to FIGS. 2A-2B, renderings of a traffic detection display according to an exemplary embodiment are shown. Traditionally, traffic warning systems identify the locations of proximal aircraft 202, 204, 206 and render their relative locations with respect to the present aircraft 200. Where a significant number of proximal aircraft 202, 204, 206 are present, the traffic detection display becomes cluttered, difficult to read, and does not clearly render useful traffic data.

An on-board system defines a plurality of risk boundaries 214, 216, 218 for each proximal aircraft 202, 204, 206, potentially weighted according to the current trajectory 208, 210, 212 of each proximal aircraft 202, 204, 206. Such risk boundaries may be defined by distance from the corresponding proximal aircraft 202, 204, 206; distance from a projection flight path of the corresponding proximal aircraft 202, 204, 206; an algorithmic function defining a potential collision possibility based on the projection flight path of the corresponding proximal aircraft 202, 204, 206 and the known flight path of the present aircraft 200; etc.

Once all of the risk boundaries are defined for each proximal aircraft 202, 204, 206, overlapping or nearly overlapping risk boundaries of the same risk level are merged to produce unified risk regions 220, 222 to indicate where traffic density presents a greater or lesser risk to the present aircraft 200. In at least one embodiment, the number of overlapping risk boundaries may comprise a factor in the risk level of the resulting unified risk region 220, 222; for example, where a threshold number of proximal aircraft 202, 204, 206 each have low-risk boundaries that combine to produce a unified low-risk region 222 (for example, rendered in green), some portion of the low-risk region 222 may be characterized as a medium-risk region 220 based on the number of proximal aircraft 202, 204, 206. Overlapping trajectories and positions are combined to form unified risk regions 220, 222 with an estimated hazard level associated with a color similar to a weather display's green, yellow, and red with each respective color indicating a higher level of hazard.

In at least one embodiment, the system may be initiated based on a threshold number of aircraft. For example, the system may render traditional diamond icons until a predefined number of aircraft are represented. At that point risk boundary regions 220, 222 are rendered and the diamond icons are suppressed for clarity.

In at least one embodiment, the system renders one or more directional arrows 228 indicating a general movement trend of a corresponding risk boundary 218 or risk boundary region 220, 222 based on recorded changes over time. Alternatively, or in addition, the system may render growth arrows 224, 226 indicating if a risk boundary region 220, 222 is growing or shrinking based on trends over time or projected traffic changes within the risk boundary region 220, 222; for example, as traffic is increasing, the growth arrows 224, 226 may point outward, and as traffic is decreasing, the growth arrows 224, 226 may point inward.

Embodiments of the present disclosure provide a high-traffic zone display to indicate areas of active and potential traffic congestion. A consolidated traffic system collects current traffic positions as well as trajectories and wake trails.

Figure 3A:
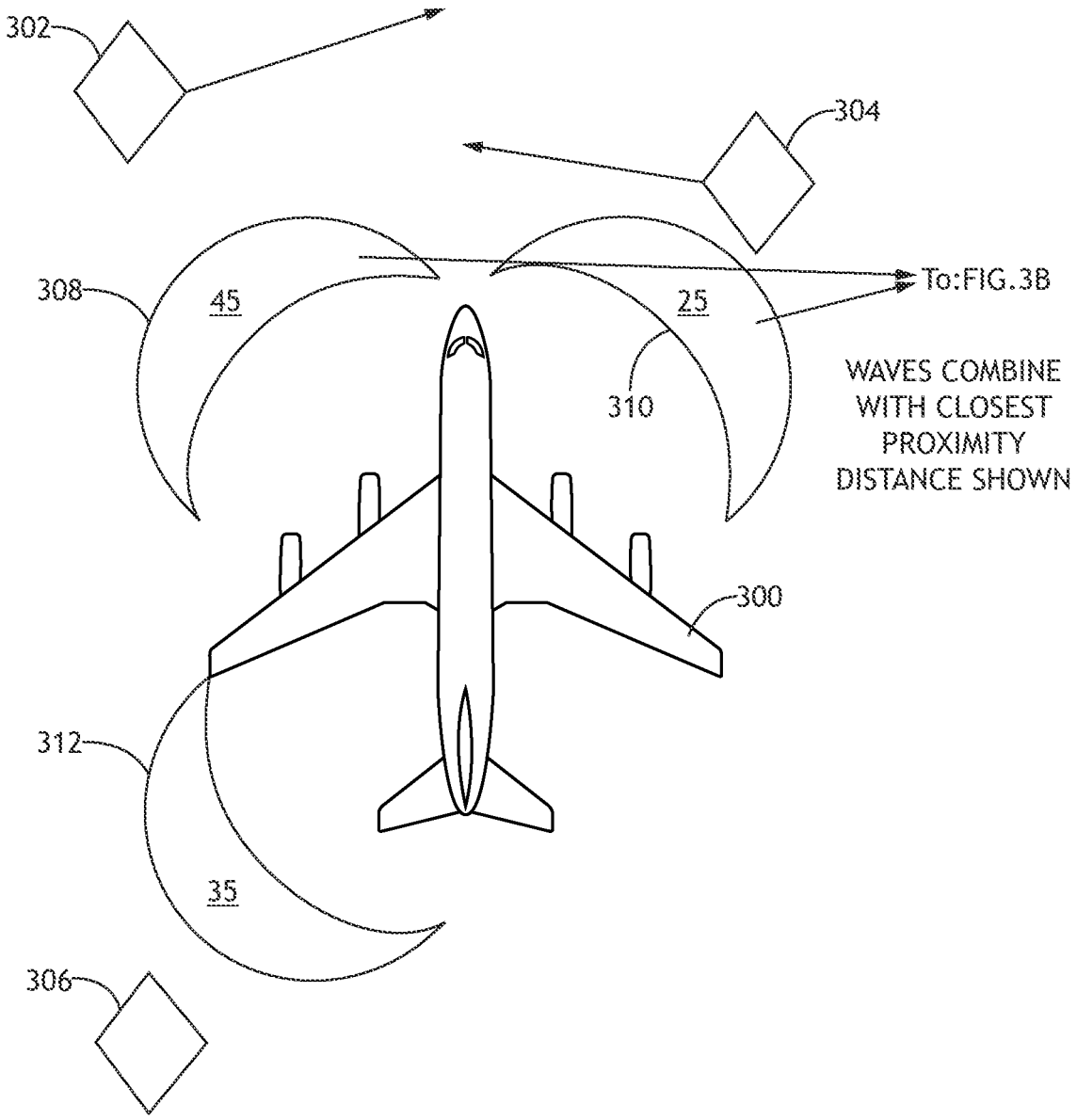
FIG. 3A shows a rendering of a traffic detection display according to an exemplary embodiment.
Figure 3B:
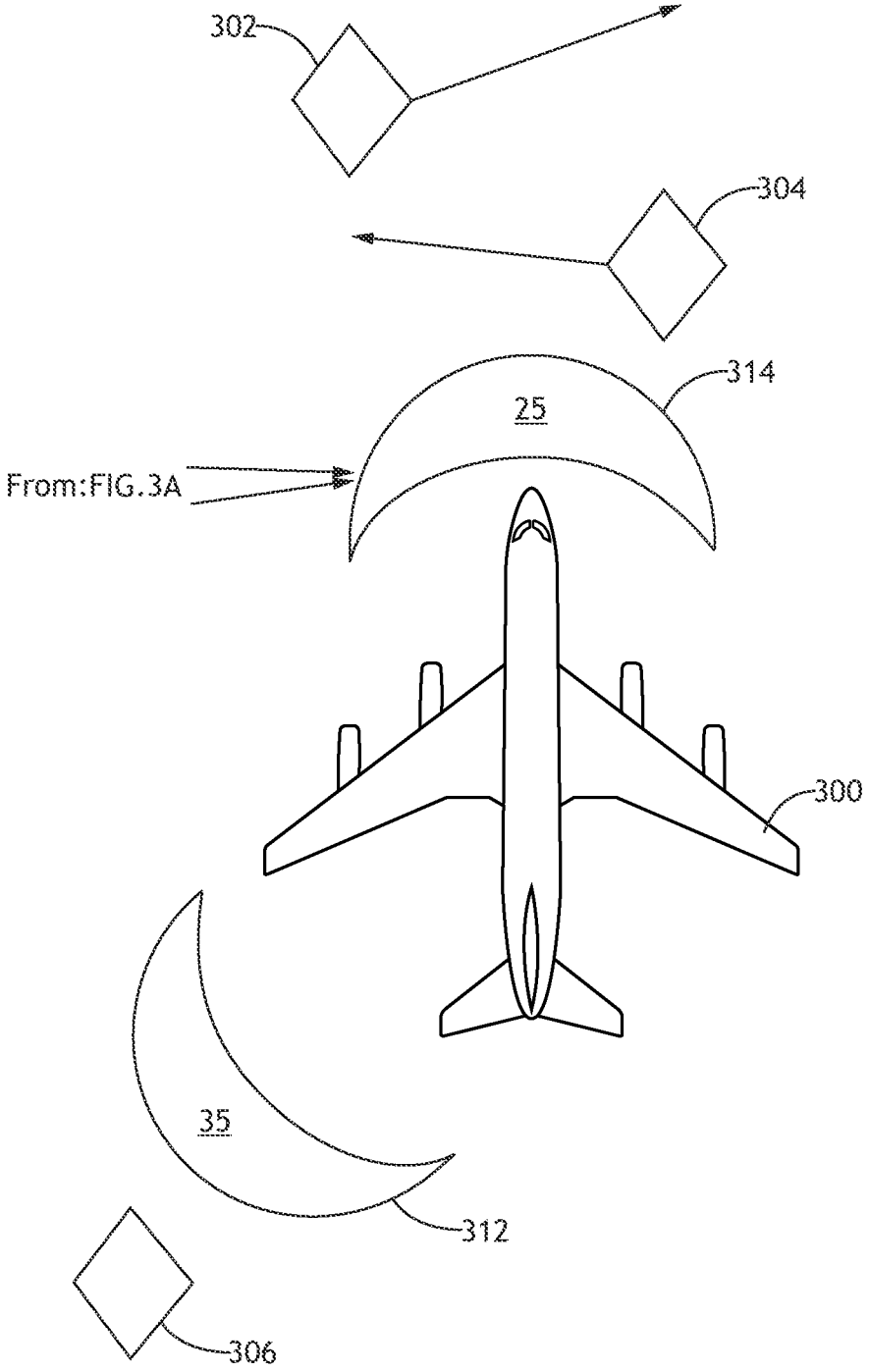
FIG. 3B shows a rendering of a traffic detection display according to an exemplary embodiment.

Referring to FIGS. 3A-3B, renderings of a traffic detection display according to an exemplary embodiment are shown. A traffic detection system identifies the locations of proximal aircraft 302, 304, 306 and renders their relative locations with respect to the present aircraft 300. Traditional, range rings are rendered to identify a distance of each proximal aircraft 302, 304, 306 to the present aircraft 300.

In at least one embodiment, the traffic detection system renders an artifice 308, 310, 312 indicating the direction and range of each proximal aircraft 302, 304, 306 with respect to the present aircraft 300. In at least one embodiment, the artifices 308, 310, 312 comprise crescents centered on the direction to the corresponding proximal aircraft 302, 304, 306 with a numerical range indicator. A crescent artifice 308, 310, 312 may define a probability of future proximal aircraft 302, 304, 306 course deviations.

In at least one embodiment, where the movement of proximal aircraft 302, 304, 306 cause the artifices 308, 310, 312 to intersect or overlap, the system may reduce visual clutter by merging the corresponding artifices 308, 310, 312 and only rendering a single artifice 314 showing the range to the nearest proximal aircraft 302, 304, 306. The single artifice 314 may be consolidated using a priority scheme based on movement in relation to the present aircraft 300 as well as the current straight-line distance.

Foldable wing components such as winglets and the variety of UAM vehicle airframes may complicate storage and navigation. Rental companies for example will likely have to store hundreds of vehicles in cramped hangars and parking decks significantly increasing the need for a simplified proximity system to prevent damage to people and property. Embodiments of the present disclosure may enable a means of installation testing and integration of ESA panels and equivalent proximity sensors surrounding the aircraft.

It is believed that the inventive concepts disclosed herein and many of their attendant advantages will be understood by the foregoing description of embodiments of the inventive concepts disclosed, and it will be apparent that various changes may be made in the form, construction, and arrangement of the components thereof without departing from the broad scope of the inventive concepts disclosed herein or without sacrificing all of their material advantages; and individual features from various embodiments may be combined to arrive at other embodiments. The form herein before described being merely an explanatory embodiment thereof, it is the intention of the following claims to encompass and include such changes. Furthermore, any of the features disclosed in relation to any of the individual embodiments may be incorporated into any other embodiment.

What is claimed is:

1. A computer apparatus comprising:

at least one processor in data communication with a memory storing processor executable code for configuring the at least one processor to:

receive a plurality of aircraft locations, each associated with a corresponding aircraft;

determine a plurality of risk boundaries associate with each aircraft location, each risk boundary corresponding to a threshold risk level defined by a proximity to the corresponding aircraft location;

determine that risk boundaries corresponding to a same threshold risk level of two or more aircraft overlap;

produce a unified risk boundary corresponding to the same threshold risk level encompassing the same threshold risk level boundaries of the two or more aircraft; and render the unified risk boundary on a display device in data communication with the at least one processor.

2. The computer apparatus claim 1, wherein the plurality of aircraft locations further comprise an altitude associated with each corresponding aircraft.

3. The computer apparatus claim 2, wherein the at least one processor is further configured to receive a trajectory associated with each corresponding aircraft, wherein each risk boundary is weighted according to trajectory.

4. The computer apparatus claim 1, wherein the at least one processor is further configured to:

determine a range and a direction to each of the corresponding aircraft; and render an artifice at a relative location around a depiction of a present aircraft corresponding to the direction of each corresponding aircraft, and including a range indicator to the corresponding aircraft.

5. The computer apparatus claim 4, wherein the at least one processor is further configured to:

determine that two or more artifices occupy the same relative location; and combine the two or more artifices utilizing the closest range.

6. The computer apparatus claim 4, wherein each artifice comprises a crescent centered on the relative direction of the corresponding aircraft.

7. The computer apparatus claim 6, wherein the disposition of the crescent is further weighted according to a trajectory of the corresponding aircraft.

8. A method comprising:

receiving a plurality of aircraft locations, each associated with a corresponding aircraft;

determining a plurality of risk boundaries associate with each aircraft location, each risk boundary corresponding to a threshold risk level defined by a proximity to the corresponding aircraft location;

determining that risk boundaries corresponding to a same threshold risk level of two or more aircraft overlap;

producing a unified risk boundary corresponding to the same threshold risk level encompassing the same threshold risk level boundaries of the two or more aircraft; and rendering the unified risk boundary.

9. The method of claim 8, wherein the plurality of aircraft locations further comprise an altitude associated with each corresponding aircraft.

10. The method of claim 9, further comprising receiving a trajectory associated with each corresponding aircraft, wherein each risk boundary is weighted according to trajectory.

11. The method of claim 8, further comprising:

determining a range and a direction to each of the corresponding aircraft; and rendering an artifice at a relative location around a depiction of a present aircraft corresponding to the direction of each corresponding aircraft, and including a range indicator to the corresponding aircraft.

12. The method of claim 11, further comprising:

determining that two or more artifices occupy the same relative location; and combining the two or more artifices utilizing the closest range.

13. The method of claim 11, wherein each artifice comprises a crescent centered on the relative direction of the corresponding aircraft.

14. The method of claim 13, wherein the disposition of the crescent is further weighted according to a trajectory of the corresponding aircraft.

* * * * *